United States Patent [19]

Tran et al.

[11] Patent Number: 4,749,906

[45] Date of Patent: Jun. 7, 1988

[54] MULTIPLE BEAM LASERTRON

[75] Inventors: Duc T. Tran, Bures sur Yvetie; Georges Faillon, Meudon, both of France

[73] Assignee: Thomson-CSF, Paris, France

[21] Appl. No.: 54,507

[22] Filed: May 27, 1987

[30] Foreign Application Priority Data

May 30, 1986 [FR] France ..... 86 07826

[51] Int. Cl.[4] ..... H01J 25/02

[52] U.S. Cl. ..... 315/5; 250/213 VT; 315/4.0; 315/5.33

[58] Field of Search ..... 350/208, 209, 216, 213 VT; 315/5.0

[56] References Cited

U.S. PATENT DOCUMENTS

| | | | |
|---|---|---|---|
| 3,107,313 | 10/1963 | Hechtel | 315/5.16 |
| 3,356,851 | 12/1967 | Carlson | 250/213 VT |
| 3,403,257 | 9/1968 | Petroff | 329/144 |
| 4,313,072 | 1/1982 | Wilson et al. | 315/5.0 |

FOREIGN PATENT DOCUMENTS 3038405 4/1981 Fed. Rep. of Germany .

*Primary Examiner*—Harold Dixon

*Attorney, Agent, or Firm*—Oblon, Fisher, Spivak, McClelland & Maier

[57] ABSTRACT

The invention relates to multiple beam lasertrons. The n (n: integer greater than 1) electron beams of the lasertron are obtained from the same laser beam from which n secondary laser beams are extracted, by occultation, which are deflected respectively towards the n photocathodes of the lasertron.

5 Claims, 2 Drawing Sheets

MULTIPLE BEAM LASERTRON

BACKGROUND OF THE INVENTION

The present invention relates to multiple beam lasertrons.

Electronic tubes called "lasertrons" are known from articles and from the U.S. Pat. No. 4,313,072.

In these tubes a photocathode is illuminated by a laser beam whose wave length is chosen as a function of the output work of the material from which the phtocathode is formed. Thus, a laser beam pulsed at the frequency F tears packets of electrons from the photocathode at the same frequency F. These packets of electrons are then accelerated in an electrostatic electric field and thus gain in kinetic energy. They then pass through a cavity resonating at frequency F and their kinetic energy is transformed into electromagnetic energy at frequency F. The energy is taken from the cavity by coupling it to an external user circuit.

In FIGS. 1 and 2, two embodiments of lasertrons of the prior art have been shown schematically in longitudinal section.

In these FIGS., the references 1, 2 and 3 designate respectively the photocathode, the laser beam and the electron beam.

In the embodiment shown in FIG. 1, the photocathode 1 is illuminated obliquely by the laser beam 2 and the electron beam 3 propagates along the longitudinal axis XX' of the tube.

In the embodiment of FIG. 2, the laser beam 2 and the electron beam 3 propagate along the longitudinal axis XX' of the tube, but in the opposite direction.

The laser beam 2 is therefore normal to the emissive surface of the photocathode.

The electron beam 3 is accelerated by the electrostatic electric field created by an anode 4, then penetrates into a cavity 5 resonating at frequency F. A collector 6 then receives the electron beam. The electromagnetic energy is taken at frequency F from cavity 5 by coupling it to an external user circuit by a guide wave 7, associated with a window 8, as shown in FIG. 1, or by a loop 9, as shown in FIG. 2.

The advantage of lasertrons is that they are very compact tubes. In lasertrons, electron packets are torn from the photocathode at frequency F. Whereas in tubes such a klystrons, several cavities must be used for distributing the electrons of an initially continuous beam in packets.

The problem which arises with lasertrons is that they are limited in frequency and in power.

Thus, for example, in order to obtain high powers, a large current must be extracted, which requires a cathode with a large surface and the passage of a considerable beam through the cavity. The dimensions of the cavity must then be sufficient to allow the passage of this beam, which limits the operating frequency. In addition, the use of a large sized cavity results in poor coupling between the beam and the cavity, which leads to poor efficiency.

The embodiments of lasertrons which are shown in FIGS. 1 and 2 have the following drawbacks:

in the embodiment shown in FIG. 1, the photocathode is illuminated obliquely. The result is, on the one hand, poor light efficiency of the photocathode and, on the other hand, a laser beam illumination device which must be made as compact as possible for housing it in the vicinity of high voltage parts;

in the embodiment shown in FIG. 2, the laser beam and the electron beam follow the same path. Consequently, the surface of the photocathode which receives the laser beam is limited by the diameter D of the sliding tube of cavity 5 which allows these beams to pass. Furthermore, the laser beam illumination device is subjected to the bombardment of the electron beam.

SUMMARY OF THE INVENTION

The present invention provides a new lasertron structure which avoids the drawbacks of known lasertrons.

According to the present invention, there is provided a lasertron including n photocathodes (n: integer greater than 1) receiving in operation a laser beam, pulsed at a frequency F, and emitting n electron beams; m (m: integer greater than 0) resonating cavities which resonate at the frequency F; n sliding tubes allowing the passage of the n electron beams; a collector; and director means situated in the vicinity of the photocathodes providing, in operation, oblique illumination of the photocathodes by the laser beam.

BRIEF DESCRIPTION OF THE DRAWINGS

Other objects, features and results of the invention will be clear from the following description given by way of non limitative example and illustrated by the accompanying Figures which show.

In the different Figures the same references designate the same elements but, for the sake of clarity, the sizes and proportions of the different elements have not been respected.

MORE DETAILED DESCRIPTION

Figure 1:
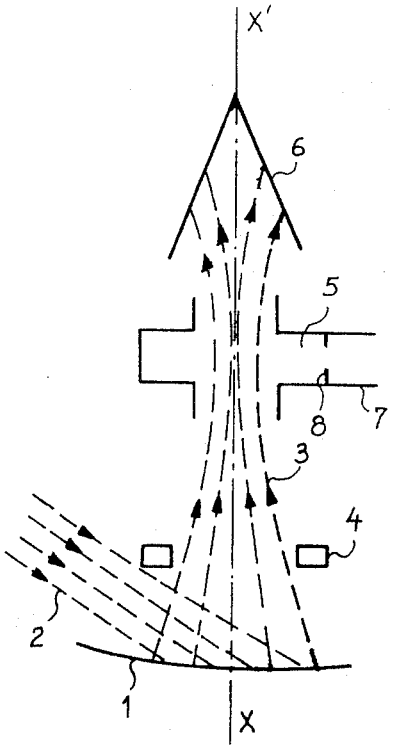
FIGS. 1 and 2, longitudinal sectional views of two embodiments of lasertrons of the prior art.
Figure 2:
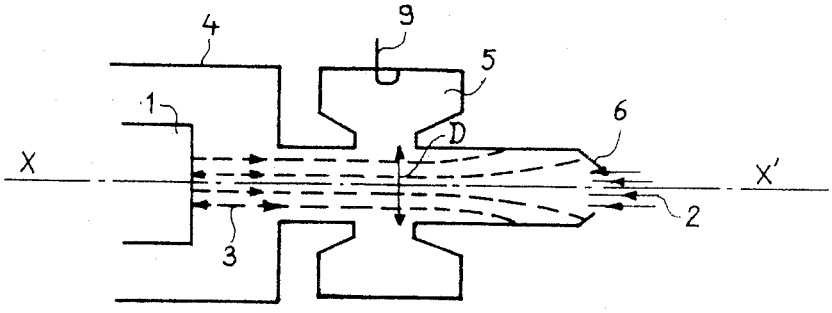

FIGS. 1 and 2 have been described in the introduction to the description.

The invention provides a new lasertron structure, called multibeam lasertron. Two embodiments of these lasertrons are shown in longitudinal section in FIGS. 3 and 4.

Multiple beam klystrons are known in the prior art from articles, as well as from the French Pat. No. 9 92 853. These kylstrons have also been described in the French patent applications Nos. 86 03949 and 86 03950, filed on the Mar. 19, 1986 in the name of the applicant and not yet published.

A great advantage of said klystrons is that they are particularly well adapted to operation at very high power. In fact, it has been demonstrated that for the same high frequency power, the acceleration voltage applied between the anode and a cathode of the klystron is much less in a multiple beam klystron than in the single beam klystrons. Now, whatever the type of klystron, the need to modulate the speed of the electron beam imposes on this acceleration voltage the same upper limit from which the beam is no longer modulable. Consequently, with a multiple beam klystron a high frequency power may be obtained much greater than the one it is possible to obtain with a single beam klystron.

Multiple beam klystrons generally operate in the TM01 mode.

It is possible to obtain high power multiple beam klystrons, at high frequencies, by dimensioning the cavities so that these klystrons operate optimally in the TM02 mode.

Multiple beam lasertrons are obtained in making modifications to single beam lasertrons of the same type as those which are made to single beam klystrons so as to obtain multiple beam klystrons.

Thus, in order to obtain a lasretron with n beams, n photocathodes are used illuminated by a laser beam. Each photocathode produces an electron beam which passes through at least one resonant cavity with n sliding tubes, before reaching a collector.

The advantages obtained by going over to multiple beam lasertrons are similar to those obtained by going over from single beam lasertrons to multiple beam klystrons.

With multiple beam lasertrons large high frequency powers may then be obtained an when they operate in the TM02 mode, high powers and high frequencies can be obtained.

Figure 3:
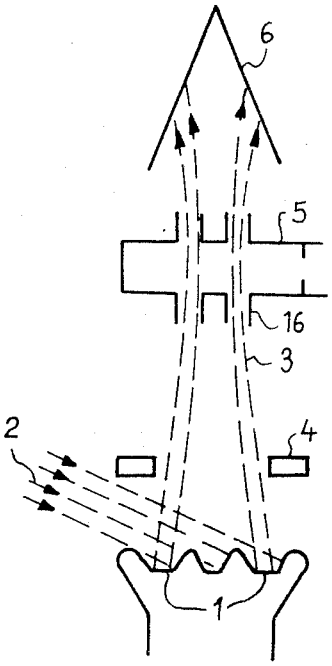
FIGS. 3 and 4 longitudinal sectional views of two embodiments of lasertrons in accordance with the invention.

FIG. 3 shows by way of example the modifications made to the lasertron of FIG. 1 so as to obtain a multiple beam lasertron.

In the case of a lasertron with n beams (n: integer greater than 1), n photocathodes, bearing the reference 1, are used and they are illuminated by the laser beam 2.

These n photocathodes 1 produce n electron beams 3 which are accelerated by n anodes 4 positively biasaed with respect to the cathodes.

The n beams 3 pass through a cavity 5 with n sliding tubes 16 and yield up their kinetic energy therein in the form of electromagnetic energy before being collected in the collector 6.

The multiple beam lasertron of FIG. 3 still has the drawbacks mentioned in the introduction to the description in connection with the single beam lasertron of FIG. 1.

Figure 4:
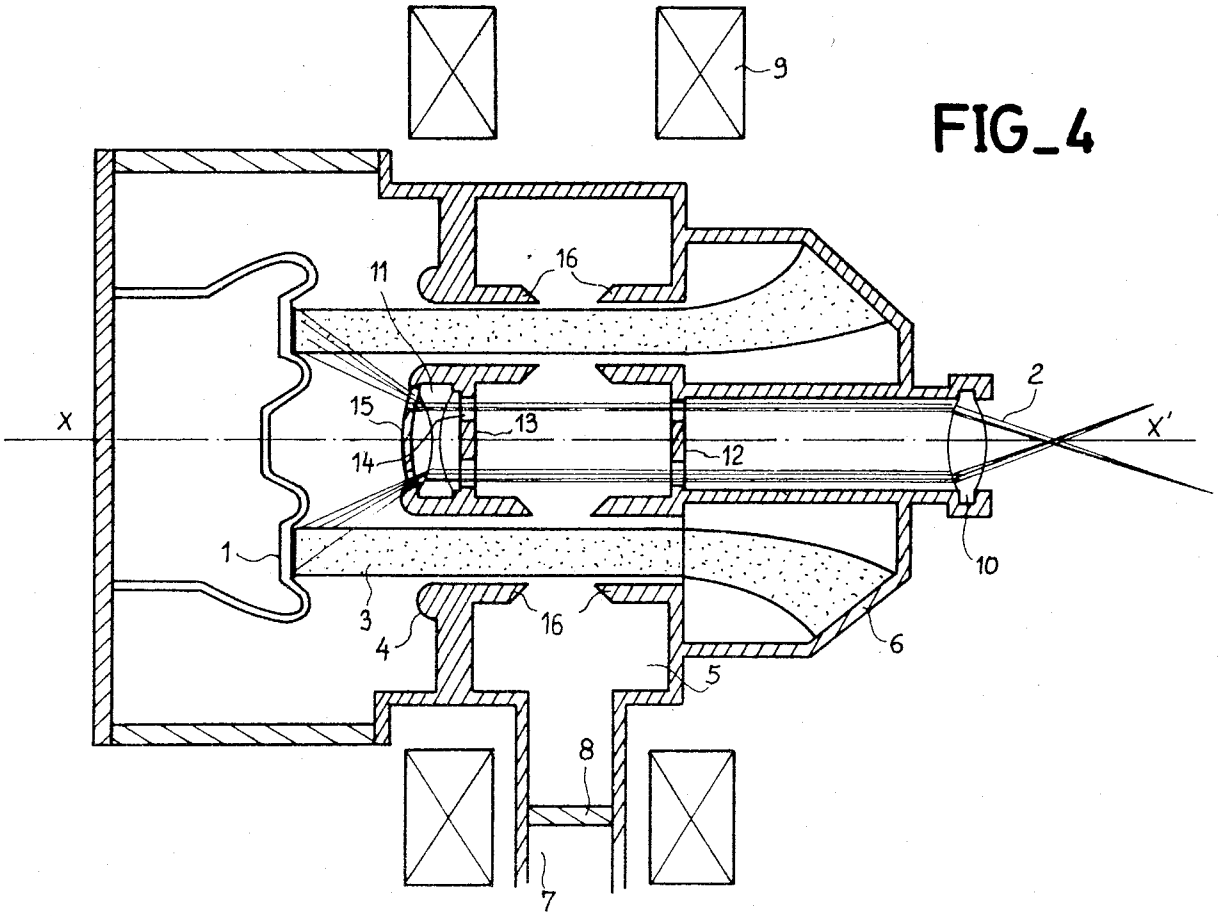

FIG. 4 is a cross sectional view of a multiple beam lasertron of entirely new structure which does not have the drawbacks of the lasertrons of FIGS. 1, 2 and 3.

This lasertron includes n photocathodes 1 which are spaced evenly apart about the longitudinal axis XX' of the tube.

An incident laser beam 2 arrives on an optical system 10, which may be formed by a lens, made from quartz for example.

Preferably, the incident laser beam is annular. This optical system 10 is centered on the axis XX'. It is placed in front of the collector, in the direction of propagation of the laser beam, as can be seen in FIG. 4. The optical system produces a laser beam which moves parallel to the longitudinal axis XX' of the tube.

The lasertron of FIG. 4 has a single resonance cavity 6, whose walls 12 and 13, perpendicular to the axis XX', are formed with n orifices 14. These orifices allow n laser beams to be obtained during operation. A cooling device, not shown, is disposed on the wall 12 of cavity 5 which receives the impact of the laser beam and which transforms it into n laser beams, thus, a part of the power of the laser is collected.

The diameter of the orifices 14 allowing the n laser beams to pass is chosen, as well as the thickness of the walls 12 and 13 of the cavity, so as to limit the leak of electromagnetic energy coming from the cavity.

After the n laser beams have passed through the cavity, another optical system 11 is provided, which may be formed by a lens; this optical system deflects the n laser beams so that they illuminate the n photocathodes at an angle as little slanting as possible.

On the side where it is facing the photocathodes, optical system 11 includes a plate 15 protecting it against different deposits, which may result from the evaporation of different constituents of photocathodes.

The n photocathodes, illuminated by n laser beams, each emit an electron beam 3, focused by anodes 4 and which pass through cavity 5 through n sliding tubes 16 before falling on the collector 6. In cavity 5, the electromagnetic power is taken off by a wave guide 7, through a dielectric window 8. Coils 9 provide focusing for the n electron beams.

The lasertron of FIG. 4, besides the advantages inherent in multiple beam lasertrons, has numerous other advantages.

Thus, contrary to what happens in the embodiment of FIG. 2, the optical system which produces the laser beam and which focuses it does not receive any electron beam which risks damaging it and making it opaque.

The two optical systems 10 and 11 are also protected from the electron beams. Plate 15 protects lens 11 from the products which may come from the photocathodes.

The laser beams illuminate the photocathodes with a substantially normal incidence which improves the light yield of the photocathodes.

It should be noted that laser beams including several successive cavities, generally 2, are known. The invention relates then to multiple beam lasertrons, having one or several successive cavities.

What is claimed is:

1. A lasertron including n photocathodes (n: integer greater than 1) receiving in operation a laser beam, pulsed at a frequency F, and emitting n electron beams; m (m: integer greater than 0) resonating cavities which resonate at a frequency F; n sliding tubes allowing the passage of the n electron beams; a collector; and director means situated in the vicinity of the photocathodes providing, in operation, oblique illumination of the photocathodes by the laser beam.

2. A lasertron as claimed in claim 1, having a longitudinal axis; a first and a second optical system, centered on the axis, the first optical system being placed in front of the collector, in the direction of propagation of the laser beam, this first optical system receiving in operation the laser beam and producing a main laser beam, parallel to the axis; in which the m cavities have walls perpendicular to the longitudinal axis, these walls being formed with n orifices allowing in operation the pasage of n secondary laser beams, parallel to the axis, obtained from the main laser beam; and wherein the second optical system, being placed in front the cathodes in the direction of propagation of the laser beams, in operation deflects the n secondary beams so that they illuminate respectively the n photocathodes.

3. A laser beam as claimed in claim 2, including a plate disposed between the second optical system and the photocathodes, this plate protecting the second optical system against deposits coming from the evaporation of materials forming the photocathodes.

4. A lasertron as claimed in one of claim 1 to 3, wherein the dimensions of its m cavities are such that it operates optimally in the TM01 mode.

5. A lasertron as claimed in one of claims 1 to 3, wherein the dimensions of its m cavities are such that it operates optimally in the TM02 mode.

* * * * *